US006692045B1

(12) United States Patent
Mc Call, Jr.

(10) Patent No.: US 6,692,045 B1
(45) Date of Patent: Feb. 17, 2004

(54) RETROFITTABLE CAP LOCKING DEVICE

(76) Inventor: Matthew Mc Call, Jr., 84 S. 28th St., Wyandanch, NY (US) 11798

( * ) Notice: Subject to any disclaimer, the term of this patent is extended or adjusted under 35 U.S.C. 154(b) by 0 days.

(21) Appl. No.: 09/591,065

(22) Filed: Jun. 9, 2000

(51) Int. Cl.[7] ..... B65D 55/14

(52) U.S. Cl. ..... 292/281; 292/286; 70/164; 70/177; 70/180

(58) Field of Search ..... 70/232, 176–178, 70/180, 164, 159; 292/281, 285, 286

(56) References Cited

U.S. PATENT DOCUMENTS 1,831,513 A * 11/1931 Sitz
1,832,057 A * 11/1931 Stein
1,944,535 A 1/1934 White
1,947,081 A * 2/1934 Grady
1,997,107 A 4/1935 Cullinan
3,264,850 A * 8/1966 Bower
3,930,388 A 1/1976 Barras
4,030,628 A * 6/1977 Hippert
3,759,075 A 9/1979 Lipschutz
4,613,055 A 9/1986 Connors
5,238,141 A 8/1993 Callegari et al.
5,533,766 A 7/1996 Farber

* cited by examiner

*Primary Examiner*—Flemming Saether

(57) ABSTRACT

A retrofittable cap locking device for removably fitting over the stem of a fuel tank such that the cap of the stem cannot be removed. The retrofittable cap locking device includes a base portion. The base portion has an opening therein for receiving the stem of a tank designed for holding fuel and oil. The base portion has a peripheral edge. A cover portion comprises a plate having a top side, a bottom side and a peripheral wall extending therebetween. The bottom side has a flange thereon. The flange has a size adapted to fit around the cap of the stem. A first rod has a first end fixedly coupled to the peripheral wall and a second end hingedly coupled to the peripheral edge. The first rod is orientated generally perpendicular to a plane of the plate such that the rod extends away from the bottom side of the plate. A second rod is fixedly coupled to the peripheral wall. The second rod extends in the same direction as, and is orientated generally perpendicular to, the first rod. The first rod has a free end adapted to be releasably lockable to the base portion.

1 Claim, 2 Drawing Sheets

RETROFITTABLE CAP LOCKING DEVICE

BACKGROUND OF THE INVENTION

1. Field of the Invention

The present invention relates to cap locking devices and more particularly pertains to a new retrofittable cap locking device for removably fitting over the stem of a fuel tank such that the cap of the stem cannot be removed.

2. Description of the Prior Art

The use of cap locking devices is known in the prior art. More specifically, cap locking devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 1,944,535; 5,533,766; 3,759,075; 3,930,388; 1,997,107; 5,238,141; and 4,613,055.

While these devices fulfill their respective, particular objectives and requirements, the aforementioned patents do not disclose a new retrofittable cap locking device. The inventive device includes a base portion. The base portion has an opening therein for receiving the stem of a tank designed for holding fuel and oil. The base portion has a peripheral edge. A cover portion comprises a plate having a top side, a bottom side and a peripheral wall extending therebetween. The bottom side has a flange thereon. The flange has a size adapted to fit around the cap of the stem. A first rod has a first end fixedly coupled to the peripheral wall and a second end hingedly coupled to the peripheral edge. The first rod is orientated generally perpendicular to a plane of the plate such that the rod extends away from the bottom side of the plate. A second rod is fixedly coupled to the peripheral wall. The second rod extends in the same direction as, and is orientated generally perpendicular to, the first rod. The first rod has a free end adapted to be releasably lockable to the base portion.

In these respects, the retrofittable cap locking device according to the present invention substantially departs from the conventional concepts and designs of the prior art, and in so doing provides an apparatus primarily developed for the purpose of removably fitting over the stem of a fuel tank such that the cap of the stem cannot be removed.

SUMMARY OF THE INVENTION

In view of the foregoing disadvantages inherent in the known types of cap locking devices now present in the prior art, the present invention provides a new retrofittable cap locking device construction wherein the same can be utilized for removably fitting over the stem of a fuel tank such that the cap of the stem cannot be removed.

The general purpose of the present invention, which will be described subsequently in greater detail, is to provide a new retrofittable cap locking device apparatus and method which has many of the advantages of the cap locking devices mentioned heretofore and many novel features that result in a new retrofittable cap locking device which is not anticipated, rendered obvious, suggested, or even implied by any of the prior art cap locking devices, either alone or in any combination thereof.

To attain this, the present invention generally comprises a base portion. The base portion has an opening therein for receiving the stem of a tank designed for holding fuel and oil. The base portion has a peripheral edge. A cover portion comprises a plate having a top side, a bottom side and a peripheral wall extending therebetween. The bottom side has a flange thereon. The flange has a size adapted to fit around the cap of the stem. A first rod has a first end fixedly coupled to the peripheral wall and a second end hingedly coupled to the peripheral edge. The first rod is orientated generally perpendicular to a plane of the plate such that the rod extends away from the bottom side of the plate. A second rod is fixedly coupled to the peripheral wall. The second rod extends in the same direction as, and is orientated generally perpendicular to, the first rod. The first rod has a free end adapted to be releasably lockable to the base portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new retrofittable cap locking device apparatus and method which h as many of the advantages of the cap locking devices mentioned heretofore and many novel features that result in a new retrofittable cap locking device which is not anticipated, rendered obvious, suggested, or even implied by any of the prior art cap locking devices, either alone or in any combination thereof.

It is another object of the present invention to provide a new retrofittable cap locking device which may be easily and efficiently manufactured and marketed.

It is a further object of the present invention to provide a new retrofittable cap locking device which is of a durable and reliable construction.

An even further object of the present invention is to provide a new retrofittable cap locking device which is susceptible of a low cost of manufacture with regard to both materials and labor, and which accordingly is then susceptible of low prices of sale to the consuming public, thereby making such retrofittable cap locking device economically available to the buying public.

Still yet another object of the present invention is to provide a new retrofittable cap locking device which provides in the apparatuses and methods of the prior art some of the advantages thereof, while simultaneously overcoming some of the disadvantages normally associated therewith.

Still another object of the present invention is to provide a new retrofittable cap locking device for removably fitting over the stem of a fuel tank such that the cap of the stem cannot be removed.

Yet another object of the present invention is to provide a new retrofittable cap locking device which includes a base portion. The base portion has an annular aperture therein for receiving the stem of a tank designed for holding fuel and oil. The base portion has a peripheral edge. A cover portion comprises a plate having a top side, a bottom side and a peripheral wall extending therebetween. The bottom side has a flange thereon. The flange has a size adapted to fit around the cap of the stem. A first rod has a first end fixedly coupled to the peripheral wall and a second end hingedly coupled to the peripheral edge. The first rod is orientated generally perpendicular to a plane of the plate such that the rod extends away from the bottom side of the plate. A second rod is fixedly coupled to the peripheral wall. The second rod extends in the same direction as, and is orientated generally perpendicular to, the first rod. The first rod has a free end adapted to be releasably lockable to the base portion.

Still yet another object of the present invention is to provide a new retrofittable cap locking device that may be used for any stem by varying the size of the opening in the base portion to fit the stem to be covered.

Even still another object of the present invention is to provide a new retrofittable cap locking device that may be removed for use on multiple tanks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
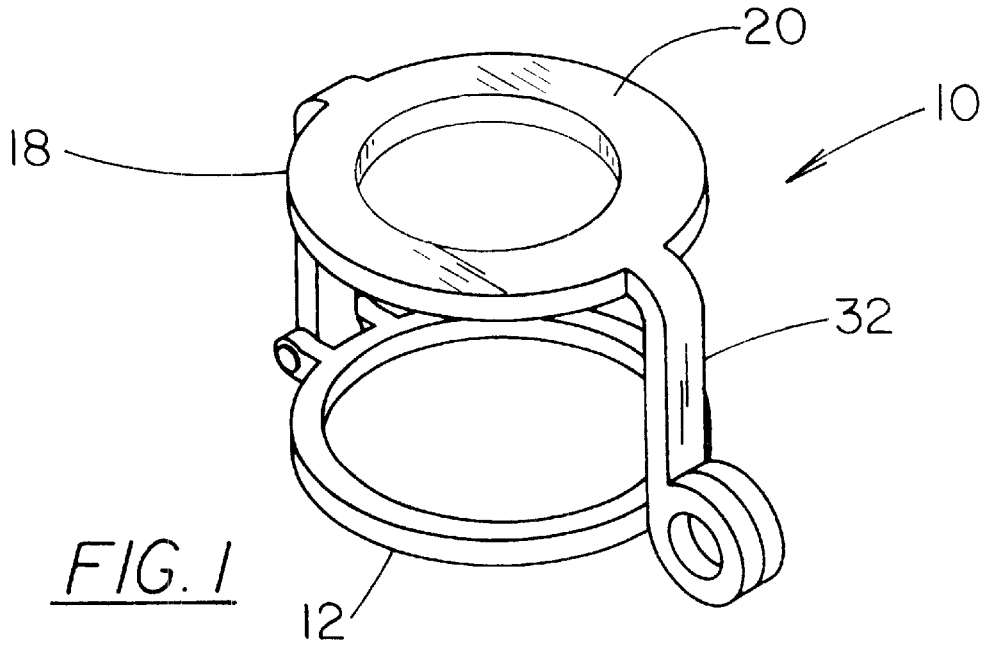
FIG. 1 is a schematic perspective view of a new retrofittable cap locking device according to the present invention.
Figure 2:
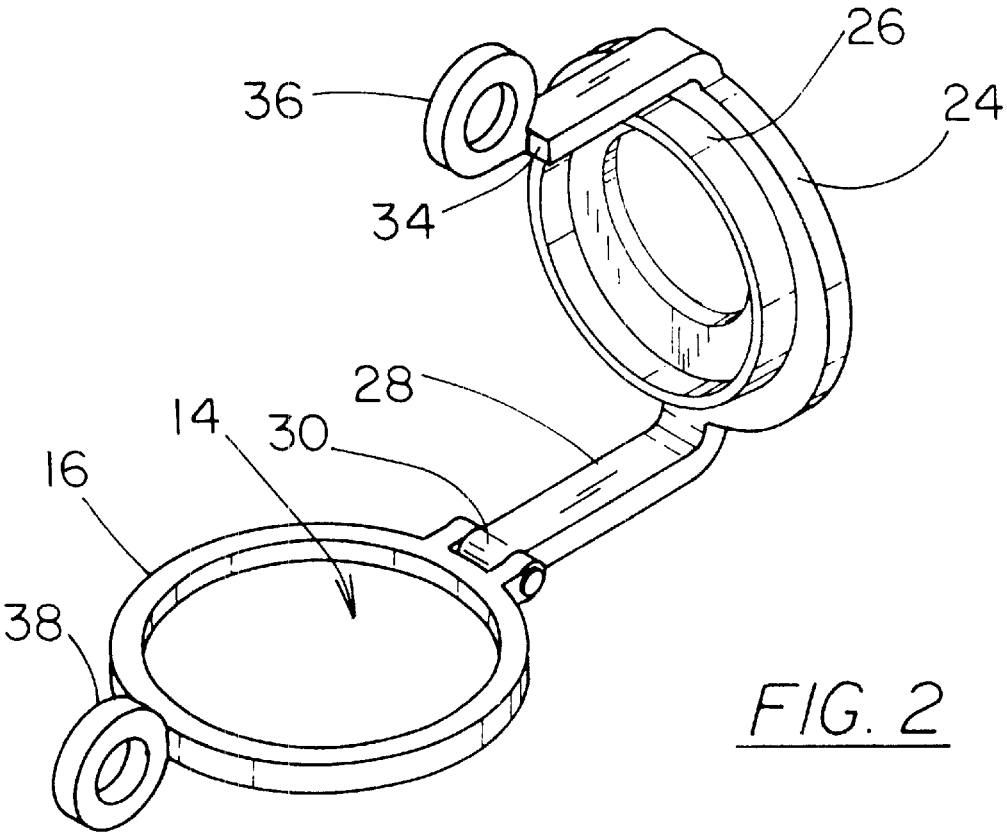
FIG. 2 is a schematic perspective view of the present invention.
Figure 3:
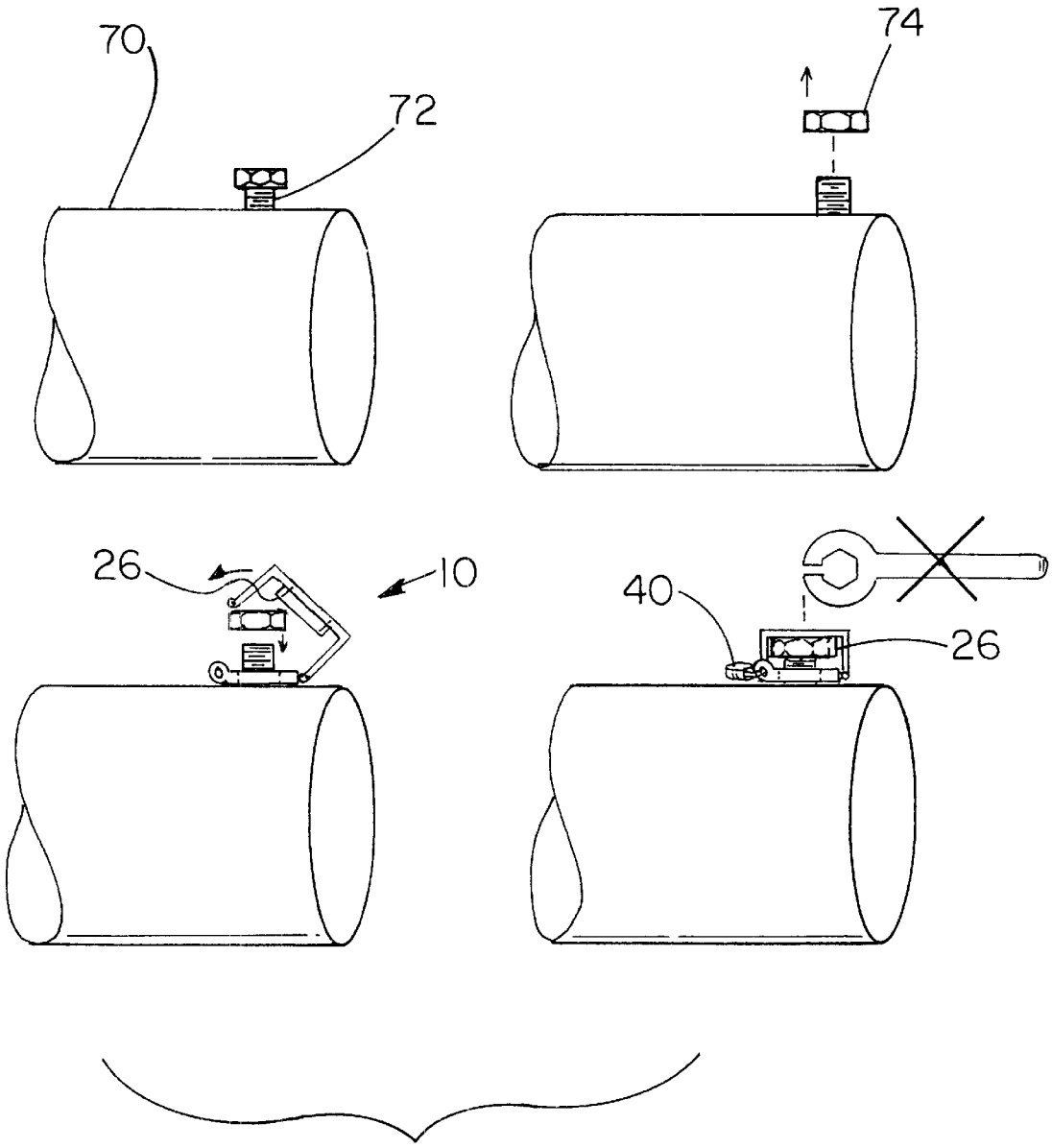
FIG. 3 is a schematic side view of the present invention in use.

With reference now to the drawings, and in particular to FIGS. 1 through 3 thereof, a new retrofittable cap locking device embodying the principles and concepts of the present invention and generally designated by the reference numeral 10 will be described.

As best illustrated in FIGS. 1 through 3, the retrofittable cap locking device 10 generally comprises a base portion 12. The base portion 12 comprises a ring member. The ring member has an annular aperture 14 therein having a diameter substantially equal to a diameter of a stem 72 of a fuel tank 70 such that the ring may be removably placed around the stem 72. The ring member has a peripheral edge 16.

A cover portion comprises a plate 18. The plate 18 has a top side 20, a bottom side 22 and a peripheral wall 24 extending therebetween. The bottom side 22 has a flange 26 thereon. The flange 26 comprises a generally annular flange, which is spaced from the peripheral wall 24. The flange 26 has a size adapted to fit around the cap 74. The cap 74 is generally a conventional hex-cap typically used on fuel tanks. The plate 18 has a generally circular shape.

A first rod 28 is fixedly coupled to the peripheral wall 24. The first rod 28 is orientated generally perpendicular to a plane of the plate 18 such that the rod 28 extends away from the bottom side 22 of the plate 18. A free end 30 of the rod 28 is hingedly coupled to the peripheral edge 16 of the base portion 12.

A second rod 32 is fixedly coupled to the peripheral wall 24. The second rod 32 is orientated generally perpendicular to a plane of the plate 18 such that the second rod 32 extends away from the bottom side 22 of the plate 18. The second rod 32 is generally positioned on an opposite side of the cover portion with respect to the first rod 28. The second rod 32 is orientated generally parallel to the first rod 28.

A first annular member 36 is integrally coupled to a free end 34 of the second rod 32. The first annular member 36 has an axis orientated generally perpendicular to a longitudinal axis of the second rod 32.

A second annular member 38 is integrally coupled to a peripheral edge 16 of the base portion 12. The second annular member 38 is positioned such that the first 36 and second 38 annular members are generally adjacent and coaxial when the second rod 32 is orientated generally perpendicular to a plane of the base portion 12.

In use, the base portion 12 is placed over the stem 72 and the cap 74 is placed on the step 72. The cover portion is placed over the cap 74 such that the cap 74 is within the flange 26. A locking means 40 for locking the two annular members together is selectively insertable through the first 36 and second 38 annular members to resist movement between the base 12 and cover 18 portions. The locking means 40 can be any conventional type of padlock, cable lock or the like. Also, the first 36 and second 38 annular members could themselves be a lock which is selectively opened or locked when the two are placed together.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size,. materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retrofitted cap locking device, said device being removably couplable to a stem of a tank, the stem being generally hollow and fluidly connected to the tank such that the tank may be filled via the stem, said device covering a removable cap of the stem, said device comprising:

a base portion comprising a ring member, said ring member having an annular aperture therein having a diameter substantially equal to a diameter of said stem such that said ring may be removably placed around said stem, said ring member having a peripheral edge;

a cover portion comprising a plate, said plate having a top side, a bottom side and a peripheral wall extending therebetween, said bottom side having a flange thereon, said flange comprising a generally annular flange, said flange being spaced from said peripheral wall, said flange having a size adapted to fit around the cap, said plate having a generally circular shape;

a first rod being fixedly coupled to said peripheral wall, said first rod being orientated generally perpendicular to a plane of said plate such that said rod extends away from said bottom side of said plate, a free end of said rod being hingedly coupled to said peripheral edge of said base portion;

a second rod being fixedly coupled to said peripheral wall, said second rod being orientated generally perpendicular to a plane of said plate such that said second rod extends away from said bottom side of said plate, said second rod being generally positioned on an opposite side of said cover portion with respect to said first rod, said second rod being orientated generally parallel to said first rod;

a first annular member being integrally coupled to a free end of said second rod, said first annular member having an axis orientated generally perpendicular to a longitudinal axis of said second rod;

a second annular member being integrally coupled to a peripheral edge of said base portion, said second annular member being positioned such that said first and second annular members are generally adjacent and coaxial when said second rod is orientated generally perpendicular to a plane of said base portion;

a locking means for selectively locking the first and second annular members together;

wherein said annular flange is located substantially equidistant between said peripheral wall and said inner wall;

wherein said base portion is placed over the stem and the cap is placed on the step, wherein said cover portion is placed over the cap such that said cap is within said flange; and wherein said locking means is selectively insertable through said first and second annular members to resist movement between said base and cover portions.

* * * * *